United States Patent [19]

Burgoyne et al.

[11] Patent Number: 4,535,579

[45] Date of Patent: Aug. 20, 1985

[54] ROOF BALLAST BLOCK

[75] Inventors: John V. Burgoyne, Waltham; Thomas E. Phalen, Jr., Winchester, both of Mass.

[73] Assignee: Roofblok Limited, Fitchburg, Mass.

[21] Appl. No.: 520,647

[22] Filed: Aug. 5, 1983

[51] Int. Cl.[3] ..... B32B 3/14

[52] U.S. Cl. ..... 52/408; 52/302; 52/409; 52/608

[58] Field of Search ..... 52/408, 409, 410, 602–611, 52/302, 303; 404/41, 36, 43, 34; 126/417

[56] References Cited

U.S. PATENT DOCUMENTS

| | | | |
|---|---|---|---|
| 1,558,129 | 10/1925 | Warren | 404/41 X |
| 2,192,458 | 3/1940 | Swenson et al. | 52/408 X |
| 2,671,441 | 3/1954 | Harris | 126/417 |
| 3,387,420 | 6/1968 | Long | 52/302 |
| 3,892,899 | 7/1975 | Klein | 52/408 X |

FOREIGN PATENT DOCUMENTS

| | | | |
|---|---|---|---|
| 712301 | 6/1965 | Canada | 52/302 |
| 1268350 | 5/1968 | Fed. Rep. of Germany | 52/302 |
| 378510 | 7/1964 | Switzerland | 52/302 |

*Primary Examiner*—Donald G. Kelly
*Assistant Examiner*—Richard E. Chilcot, Jr.

[57] ABSTRACT

A roof ballast block having generally rectangular top and bottom faces and two parallel edges bevelled at substantially identical angles of 12° to 23° from the vertical, the remaining two edges being substantially vertical, the block having a plurality of parallel spaced channels in its bottom face and being characterized by a density of 85 to 155 pounds per cubic foot, a compressive strength of at least 2500 psi, a flexure strength of at least 300 psi, and a capability of undergoing at least 100 freeze-thaw cycles without cracking.

4 Claims, 12 Drawing Figures

ROOF BALLAST BLOCK

This invention relates to a ballast block for roof construction having an improved configuration and characteristics which provide enhanced durability and resistance to weathering.

It has long been the practice to provide roof constructions comprising a deck covered by a water impermeable membrane, the membrane being held in place and protected by loose ballast blocks, as described, for example, in Klein U.S. Pat. No. 3,892,899, with or without additional layers of thermal insulation and/or wear-resistant outer protective layers.

Conventional ballast blocks having vertical edges and flat bottom faces have exhibited a number of shortcomings. The blocks impede drainage of rain and moisture from the surface of the membrance and from the spaces between blocks; in cold weather, freezing of the water between adjacent blocks causes cracking or disruption of the blocks, and removal or replacement of the blocks is difficult because of the narrow spacing between them. Moreover, such blocks are subject to disruption or breakage when the roof is exposed to high winds unless the blocks are excessively heavy. Heavy blocks are difficult to handle and to install manually and require stronger supports for the roof deck.

It has now been found that these and other problems can be solved by means of a ballast block having generally rectangular top and bottom faces and two parallel edges bevelled at substantially identical angles of 12° to 23° from the vertical, the remaining two edges being substantially vertical, and having a plurality of parallel spaced channels in its bottom face, the block being characterized by a density of 85 to 155 pounds per cubic foot, a compressive strength of at least 2500 psi, a flexure strength of at least 300 psi, and a capability of undergoing at least 100 freeze-thaw cycle without cracking.

In the appended drawings,

FIG. 1 is an isometric view showing one embodiment of a ballast block in accordance with the present invention;

FIG. 1*a* is a top plan view of the block of FIG. 1;

FIG. 2 is a view similar to that of FIG. 1 showing the bottom face of the block;

FIG. 2*a* is a bottom plan view of the block;

Figure 1:
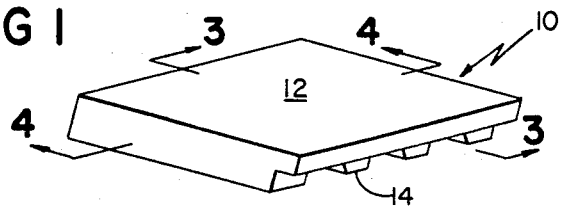
Figure 2:
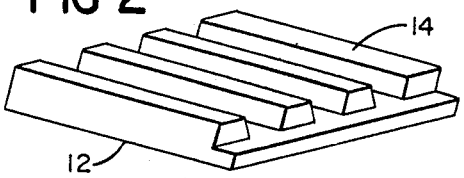
Figure 1A:
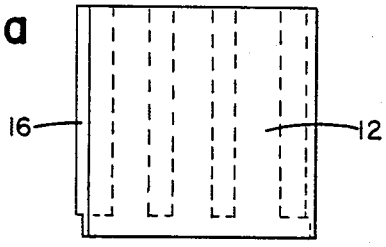
Figure 2A:
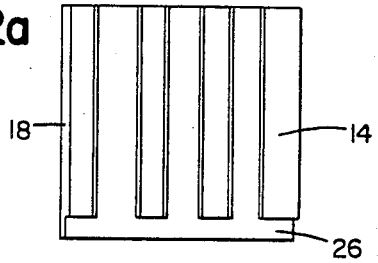
Figure 3:
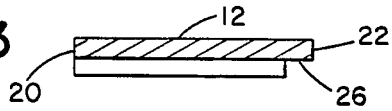
FIG. 3 is a view in section taken along line 13—3 of FIG. 1.
Figure 4:
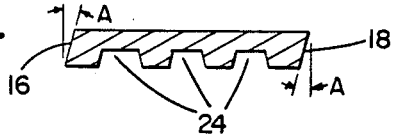
FIG. 4 is a view in section taken along line 4—4 of FIG. 1.

As appears from FIGS. 1-4 of the drawing a preferred embodiment of the invention comprises a ballast block 10 having rectangular, e.g. square top and bottom faces 12, 14 and having two parallel edges 16, 18 bevelled at substantially identical angles from the vertical. The angles A shown in FIG. 4 can vary from 12° to 23°. The remaining two edges 20,22 are substantially vertical. In the bottom face 14 are a plurality of parallel spaced channels 24,24 parallel to bevelled edges 16,18, and an additiional optional channel 26 which is transverse to the parallel channels 24 and which extends adjacent and parallel to vertical edge 22. While the channels 24 are parallel to bevelled edges 16,18 in the preferred embodiment, they can in an alternative embodiment be arranged parallel to the vertical edges 20,22.

The block of the preferred embodiment is composed of lightweight concrete containing expanded shale or similar aggregate made from clay, shale or slate having substantially the same physical properties, a minor proportion of sand, and Portland cement, as described in Phalen, Advances in Materials, Technology in the Americas, Vol. 1, pages 87–92 (New York 1980), the proportions being selected as described therein to provide a block having a density or specific gravity from 85 to 155 pounds per cubic foot (determined according to ASTM C 331), a compressive strength of at least 2500 psi (determined according to ASTM C 192 and C 495 using 15×30 cm. cylinders), a flexure tensile strength of at least 300 psi (determined according to ASTM C 293), and a capability of undergoing at least 100 freeze-thaw cycles without cracking (determined according to ASTM C666). The weight of a block having the configuration shown in FIGS. 1 to 4 which is 1 foot on a side and 2 inches thick is from 10 to 17 pounds per square foot of upper face.

The block of the present invention can be made in a conventional concrete block making machine by an extrusion procedure from a zero slump mixture of expanded Normanskill shale, Portland cement, sand and water in the desired proportions. Blocks made in this manner normally have channels 24 parallel to bevelled sides 16,18, and have the transverse channel 26, when present, adjacent to vertical edge 22, as shown in FIGS. 1-4 of the drawing.

When the ballast blocks are used in a loose laid roof construction, they are preferably laid with channels 24,24 parallel to the direction of slope of the roof deck to provide for maximum drainage, particularly in the case of blocks from which the optional transverse channel 26 is omitted. However, in using the preferred embodiment which includes the transverse channel 26, the direction of channels 24 after laying is of no consequence.

Figure 5:
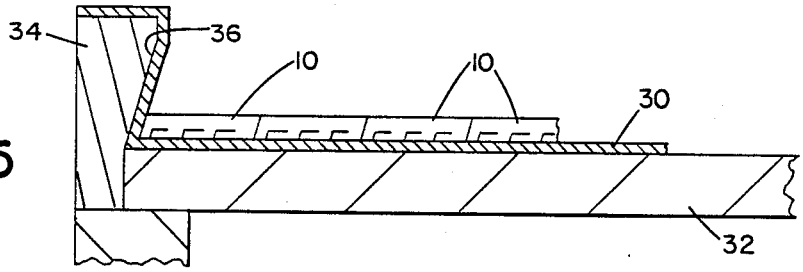
FIG. 5 is a view in cross-section partly broken away showing a roof construction embodying blocks of the present invention.
Figure 6:
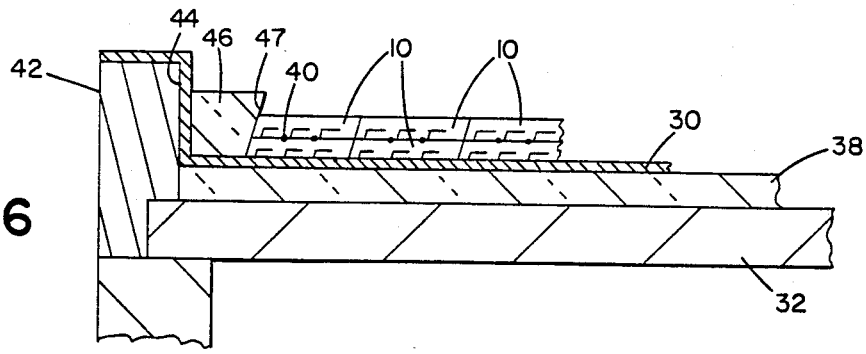
FIG. 6 is a view in cross-section partly broken away showing a second roof construction embodying blocks of the present invention.

As shown in FIG. 5, in the simplest roof construction the blocks 10 are merely laid in loosely abutting relation directly on top of water impermeable membrane 30 which in turn is supported by roof deck 32. Membrane 30 may be of any conventional composition such as butyl rubber, plastic, asphalt-impregnated felt, or the like. If desired, a parapet 34 along the edge of deck 32 is provided with a sloping inner wall 36 which overlies the bevelled edge of the outer row of blocks 10 and serves to clamp the edges of the blocks to the deck. As shown in FIG. 6, a layer of any conventional thermal-insulating material 38 such as expanded polystyrene, fiberglass, fiberboard, foamed polyurethane or the like, may be interposed between deck 32 and membrane 30, and a double layer of blocks 10 can be used. If desired, each block of the upper layer can be secured to the underlying layer by an adhesive 40. In this construction, parapet 42 has a vertical inner wall 44 against which is anchored a tapered blocking strip 46 having a sloping wall 47 serving to clamp the outer row of block 10 to the deck. Blocks 10, because of the inclusion of expanded Normanskill shale and because of the channels in the bottom face of the blocks possess an unusually low coefficient of thermal conductivity, of the order of 0.3 w/mk to 0.6 w/mk (as determined by ASTM C 177), thus making it possible to use less conventional insulation in the roof construction than is usually required, or even to dispense with it entirely.

Figure 7:
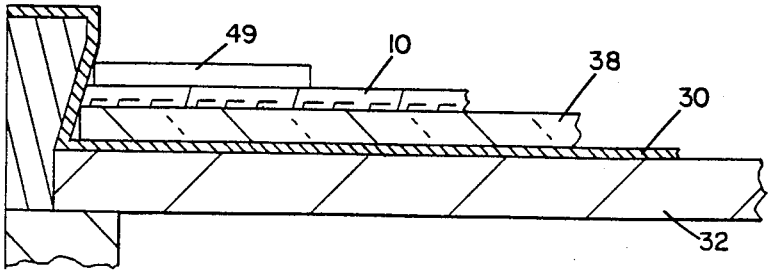
FIG. 7 is a view in cross-section partly broken away showing a third roof construction.

In the roof construction shown in FIG. 7, the layer of thermal insulation 38 is placed above the membrane 30, being interposed between membrane 30 and a layer of blocks 10. In this embodiment a second layer of conventional heavyweight blocks 49 having all four edges vertical can be laid on top of the first layer if desired.

Figure 8:
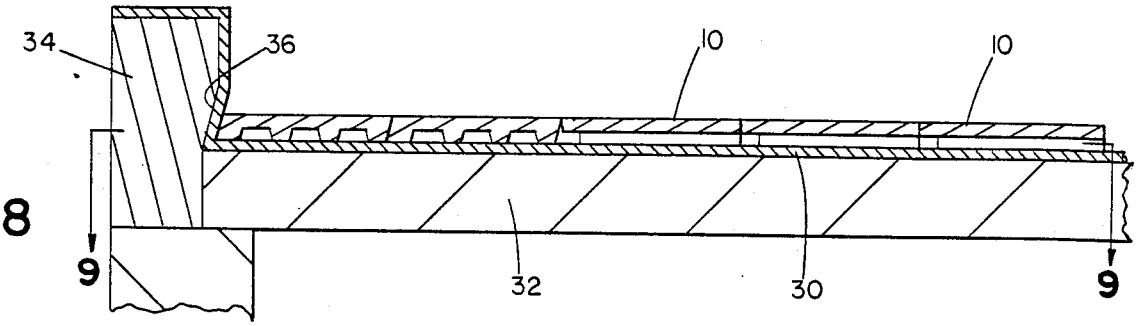
FIG. 8 is a view in cross-section partly broken away showing a preferred pattern of alignment of blocks of the present invention in a corner portion of a roof.
Figure 9:
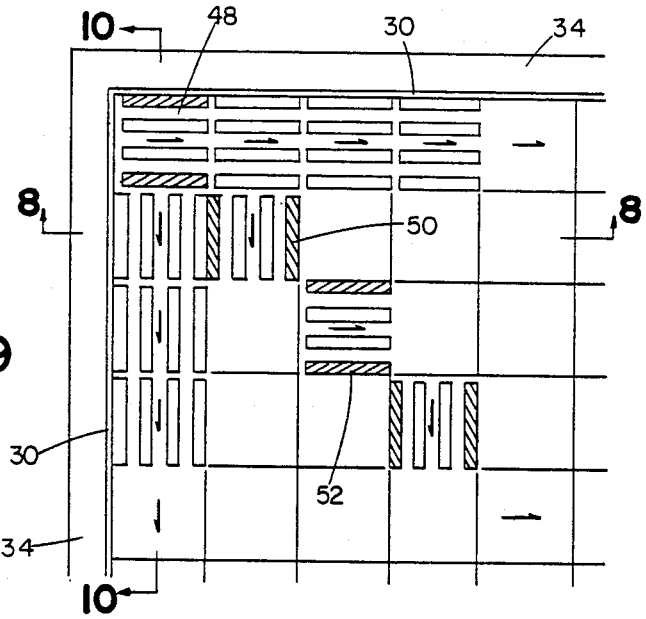
FIG. 9 is a view in section taken along line 9—9 of FIG. 8.
Figure 10:
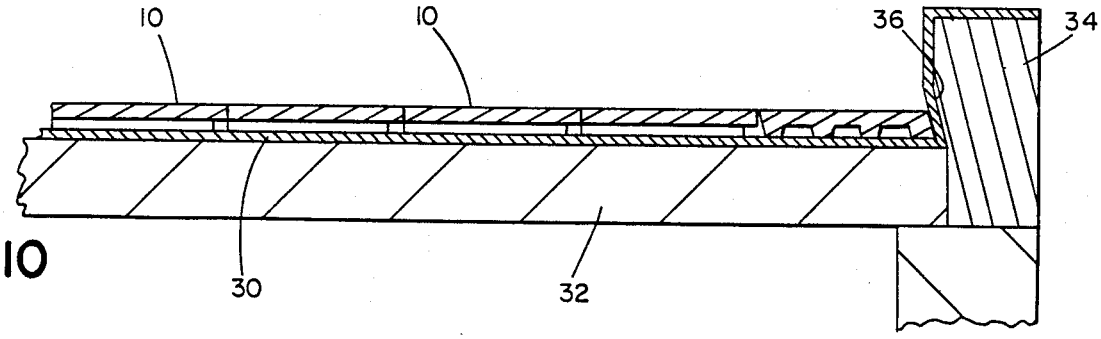
FIG. 10 is a view in section taken along line 10—10 of FIG. 9.

It has been found that high winds encountered during stormy weather present a particular problem in the case of roof constructions in which the deck has one or more square corners. In the case of such corners, maximum resistance to damage from wind forces can be achieved by laying the blocks of the present invention in a special pattern as described and claimed in the copending U.S. patent application of Thomas A. Phalen, Jr., Ser. No. 520,648, filed Aug. 5, 1983, the disclosure of which is incorporated herein by reference. The pattern is shown in FIGS. 8 to 10 of the drawings in which all of each outer row of blocks 10,10 have their outwardly and downwardly bevelled edges arranged adjacent to the outer edge of deck 32 except for corner block 48 which is not in alignment with one of the two outer rows of which it forms a corner, but instead is turned 90° so as to be in alignment with the other outer row. Similarly, each successive row of blocks inwardly from each outer row has the same alignment as the outer row with the exception that each corner block 50,52 of each successive row may be in alignment with either of the two rows of which it forms a corner. For maximum resistance to disruption it is essential that the specified pattern be maintained for at least ten rows inwardly from each edge of the deck at the corner, preferably for fifteen successive rows, and that it be maintained for at least fifteen successive blocks from the corner along the outer row. Further inwardly toward the center of the roof and away from the corner the alignment of the blocks in each row has no appreciable effect upon resistance to disruption by wind forces, so that the blocks may be laid indiscriminately, without regard to alignment. In order to provide for maximum drainage of water from the surface of the membrane, however, as pointed out above, it is desirable to have channels 24,24 of each block arranged parallel to the direction of slope of the roof deck even in the central portion of the roof.

It will be noted that in the case of blocks 10 laid in the patterns shown in FIGS. 5–7 of the drawing, the bevelled edges of the blocks facilitate sliding movement of the blocks over each other in the case of thermal expansion or contraction and also facilitate removal and/or replacement of individual blocks by the insertion of a lifting tool or pry member between the bevelled faces of adjacent blocks.

What is claimed is:

1. A roof ballast block having generally rectangular top and bottom faces, and two parallel edge faces bevelled at substantially identical angles of 12° to 23° from the vertical, the remaining two edge faces being parallel and substantially vertical, and having a plurality of parallel spaced channels in its bottom face, said block being characterized by a density of 85 to 155 lb. per cu ft., a compressive strength of at least 2500 psi, a flexure tensile strength of at least 300 psi, and a capability of undergoing at least 100 freeze-thaw cycles without cracking.

2. A ballast block as claimed in claim 1 in which said block has square top and bottom faces and in which said channels are parallel to said bevelled edge faces.

3. A ballast block as claimed in claim 1 having at least one additional channel in its bottom face transverse to said parallel channels.

4. A ballast block as claimed in claim 2 having at least one additional channel in its bottom face adjacent and parallel to one of said vertical edge faces, said block having a weight of 10 to 17 pounds per square foot of upper face.

* * * * *